US009347710B2

(12) United States Patent
Myyri et al.

(10) Patent No.: US 9,347,710 B2
(45) **Date of Patent: *May 24, 2016**

(54) METHOD FOR CONTROLLING THERMAL BALANCE OF A SUSPENSION SMELTING FURNACE AND SUSPENSION SMELTING FURNACE

(75) Inventors: Jorma Myyri, Helsinki (FI); Tapio Ahokainen, Helsinki (FI); Lauri P. Pesonen, Helsinki (FI); Peter Björklund, Espoo (FI)

(73) Assignee: Outotec Oyj, Espoo (FI)

( * ) Notice: Subject to any disclaimer, the term of this patent is extended or adjusted under 35 U.S.C. 154(b) by 177 days.

This patent is subject to a terminal disclaimer.

(21) Appl. No.: 13/882,728

(22) PCT Filed: Nov. 3, 2011

(86) PCT No.: PCT/FI2011/050966

§ 371 (c)(1),
(2), (4) Date: Jul. 23, 2013

(87) PCT Pub. No.: WO2012/059646

PCT Pub. Date: May 10, 2012

(65) Prior Publication Data

US 2013/0328250 A1 Dec. 12, 2013

(30) Foreign Application Priority Data

Nov. 4, 2010 (FI) ..... 20106156

(51) Int. Cl.
*C22B 1/00* (2006.01)
*F27D 3/00* (2006.01)
(Continued)

(52) U.S. Cl.
CPC ... *F27D 9/00* (2013.01); *C22B 5/00* (2013.01); *C22B 15/0047* (2013.01); *F27D 3/16* (2013.01)

(58) Field of Classification Search
CPC ..... F27D 9/00; F27D 3/16; C22B 5/00
USPC ..... 266/44, 171
See application file for complete search history.

(56) References Cited

U.S. PATENT DOCUMENTS 3,976,472 A * 8/1976 Linder ..... 75/10.17
4,113,470 A 9/1978 Aaltonen et al.
(Continued)

FOREIGN PATENT DOCUMENTS

DE 102005032444 A1 1/2007
EP 0 416 533 A1 3/1991
(Continued)

OTHER PUBLICATIONS

Mexican Office action issued on Jul. 24, 2014 for MX/a2013/004930, 2 pages.
(Continued)

*Primary Examiner* — Scott Kastler
(74) *Attorney, Agent, or Firm* — Chernoff,Vilhauer, McClung & Stenzel, LLP

(57) ABSTRACT

The invention relates to a method for controlling the thermal balance of a suspension smelting and to a suspension smelting furnace. The suspension smelting furnace, comprising a reaction shaft (1), a lower furnace (2), and an uptake (3), wherein the reaction shaft (1) having a shaft structure (4) that is provided with a surrounding wall structure (5) and a roof structure (6) and that limits a reaction chamber (7), and wherein the reaction shaft (1) is provided with a concentrate burner (14) for feeding pulverous solid matter and reaction gas into the reaction chamber (7). The shaft structure (4) of the reaction shaft (1) is provided with cooling means (8) for feeding endothermic material into the reaction chamber (7) of the reaction shaft (1).

42 Claims, 5 Drawing Sheets

(51) Int. Cl.

| | |
|---|---|
| ***F27D 9/00*** | (2006.01) |
| ***C22B 15/00*** | (2006.01) |
| ***C22B 5/00*** | (2006.01) |
| ***F27D 3/16*** | (2006.01) |

(56) References Cited

U.S. PATENT DOCUMENTS

| | | | | |
|---|---|---|---|---|
| 6,238,457 | B1 | 5/2001 | Holmi et al. | |
| 2012/0204679 | A1 * | 8/2012 | Sipila et al. | 75/330 |
| 2013/0328250 | A1 * | 12/2013 | Myyri et al. | 266/44 |

FOREIGN PATENT DOCUMENTS

| | | | |
|---|---|---|---|
| EP | 0499956 | A1 | 8/1992 |
| EP | H11-235515 | A | 8/1999 |
| GB | 1243568 | | 8/1971 |
| GB | 1243568 | A | 8/1971 |
| JP | S58-6946 | A | 1/1983 |
| JP | 1268809 | A | 10/1989 |
| JP | 2002060858 | A | 2/2002 |
| WO | 03/73724 | A1 | 12/2000 |
| WO | WO 2011/048265 | A1 * | 4/2011 |

OTHER PUBLICATIONS

International Search Report for PCT/FI2011/050966, completed Feb. 1, 2012, mailed Feb. 14, 2012, 3 pages.

Finnish Search Report for FI 20106156 dated Jun. 30, 2011, 1 page.

Supplementary European Search Report for corresponding European Patent Application No. 11 83 7636, dated Sep. 3, 2015, pp. 2.

English translation of Finish Patent Application No. FI 20096311, entitled,Method of Controlling the Thermal Balance of the Reaction Shaft of a Suspension Smelting Furnace and a Concentrate Burner, filed Nov. 12, 2009, pp. 12.

English translation of Finish Patent Application No. FI 20096071, entitled,"Method of Feeding Fuel Gas Into TE Reaction Shaft of a SUS-Pennsion Smelting Furnace and Concentrate Burner", filed Oct. 19, 2009, pp. 1.

Notification of Reason of Refusal prepared by the Japanese Patent Office for JP 2013-537177, mailed on Nov. 10, 2015, 9 pages.

* cited by examiner

METHOD FOR CONTROLLING THERMAL BALANCE OF A SUSPENSION SMELTING FURNACE AND SUSPENSION SMELTING FURNACE

CROSS-REFERENCE TO RELATED APPLICATIONS

This is a national stage application filed under 35 USC 371 based on International Application No. PCT/FI2011/050966 filed Nov. 3, 2011, and claims priority under 35 USC 119 of Finnish Patent Application No. 20106156 filed Nov. 4, 2010.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

Field of the Invention

The invention relates to a method for controlling the thermal balance of a suspension smelting furnace.

The invention relates to a method that takes place in the suspension smelting furnace, such as a flash smelting furnace, and to a suspension smelting furnace, such as flash the smelting furnace.

A flash smelting furnace comprises three main parts: a reaction shaft, a lower furnace and a uptake. In the flash smelting process, the pulverous solid matter that comprises a sulphidic concentrate, slag forming agent and other pulverous components, is mixed with the reaction gas by means of the concentrate burner in the upper part of the reaction shaft. The reaction gas can be air, oxygen or oxygen-enriched air. The concentrate burner comprises normally a feeder pipe for feeding the pulverous solid material into the reaction shaft, where the orifice of the feeder pipe opens to the reaction shaft. The concentrate burner further comprises normally a dispersing device, which is arranged concentrically inside the feeder pipe and which extends to a distance from the orifices of the feeder pipe inside the reaction shaft and which comprises dispersion gas openings for directing a dispersion gas to the pulverous solid matter that flows around the dispersing device. The concentrate burner further comprises normally a gas supply device for feeding the reaction gas into the reaction shaft, the gas supply device opening to the reaction shaft through an annular discharge orifice that surrounds the feeder pipe concentrically for mixing the said reaction gas that discharges from the annular discharge orifice with the pulverous solid matter, which discharges from the middle of the feeder pipe and which is directed to the side by means of the dispersion gas. The flash smelting process comprises a stage, wherein the pulverous solid matter is fed into the reaction shaft through the orifice of the feeder pipe of the concentrate burner. The flash smelting process further comprises a stage, wherein the dispersion gas is fed into the reaction shaft through the dispersion gas orifices of the dispersing device of the concentrate burner for directing the dispersion gas to the pulverous solid matter that flows around the dispersing device, and a stage, wherein the reaction gas is fed into the reaction shaft through the annular discharge orifice of the gas supply device of the concentrate burner for mixing the reaction gas with the solid matter, which discharges from the middle of the feeder pipe and which is directed to the side by means of the dispersion gas.

In most cases, the energy needed for the melting is obtained from the mixture itself, when the components of the mixture that is fed into the reaction shaft, the powdery solid matter and the reaction gas react with each other. However, there are raw materials, which do not produce enough energy when reacting together and which, for a sufficient melting, require that fuel gas is also fed into the reaction shaft to produce energy for the melting.

At present, there are various known alternatives of correcting upwards the thermal balance of the reaction shaft of the suspension smelting furnace, i.e., raising the temperature of the reaction shaft of the suspension smelting furnace to prevent the reaction shaft of the suspension smelting furnace from cooling. There are not many known ways of correcting downwards the thermal balance of the reaction shaft of the suspension smelting furnace, i.e., lowering the temperature of the reaction shaft of the suspension smelting furnace. One known method is to decrease the feed, i.e., to feed a lesser amount of concentrate and reaction gas into the reaction shaft, for example. Another known way to lowering the temperature of the reaction shaft of the suspension smelting furnace is to feed nitrogen into the reaction shaft. The drawback of this method is that the off-gases increase due to the higher nitrogen amount in the off-gases. Other known methods are to mix solid coolants together with the concentrate. The drawback of this method is that the melt amount increases and the slag composition may not be beneficial for the process. For the sake of productivity, it would be good to succeed in decreasing the thermal balance without decreasing the feed.

BRIEF SUMMARY OF THE INVENTION

The object of the invention is to provide a method for controlling the thermal balance of a suspension smelting furnace and a suspension smelting furnace for solving the above-identified problem.

SHORT DESCRIPTION OF THE INVENTION

The method and suspension smelting furnace is based on the idea of providing the shaft structure of the reaction shaft with at least one cooling means for feeding endothermic material into the reaction chamber of the reaction shaft, and of feeding endothermic material into the reaction chamber of the reaction shaft with said at least one cooling means.

The solution according to the invention enables a reduction in the melt temperature of the reaction shaft without decreasing the feed. This is due to the fact that endothermic material, which is fed into the reaction chamber of the reaction shaft, consumes energy in the reaction chamber. An endothermic material in the form of a liquid coolant can for example consume energy by evaporating in the reaction shaft and the evaporation energy is taken from the substances in the reaction shaft. The endothermic material can possibly also contain components, which in the conditions of the reaction shaft can disintegrate into smaller partial components, consuming energy according to endothermic reactions. Therefore, the temperature in the reaction shaft can be decreased in a controlled manner.

The solution according to the invention enables a reduction in the temperature of the reaction shaft without decreasing the feed. This is because the increase in temperature due to increasing the feed can be corrected by increasing the feed of the endothermic material, respectively.

An advantage with the solution is that it makes it possible to use more oxygen in the reaction gas without unnecessary raising the temperature in the reaction chamber. The reaction gas may for example contain 60-85% or up to 95% oxygen depending on availability of oxygen and analysis of solid feed material. This is commonly known as the oxygen enrichment of the reaction gas.

It is for example known that pulverous solid matter that has a high thermal value is not necessarily at the same time a material that is easy to ignite in the reaction chamber. By using a large amount of oxygen it is possible to ignite such material that is hard to ignite. By feeding endothermic material into the reaction chamber excess thermal energy resulting from such large amount of oxygen in reaction gas can be consumed.

Another advantage with high oxygen enrichment in the reaction gas is the lower nitrogen ($N_2$) amount in the off-gases. This means that most of the equipment size in the off-gas line and acid plant can be smaller compared to the case without the addition of the liquid coolant. This means a smaller investment cost for a new installation and a possibility to increase capacity of an existing installation with only minor modifications (if any) to an existing installation.

An advantage with the solution compared to cooling by feeding nitrogen in gas form into the reaction chamber is that the formation of nitrogen oxides ($NO_x$) may be reduced. Nitrogen oxides, which are harmful for the environment and not wanted in products produced from the gases which are collected from the uptake of the suspension smelting furnace, are formed if the temperature in the reaction chamber is high enough and if nitrogen is present in the reaction chamber. By feeding endothermic material into the hot zone of the reaction chamber, the flame length is increased and the high temperature zones in the reaction chamber are reduced. This means that the residence time of the suspension in these high temperature zones will be decreased, thus decreasing the formation of thermal $NO_x$ and fuel $NO_x$.

BRIEF DESCRIPTION OF THE SEVERAL VIEWS OF THE DRAWINGS

In the following the invention will described in more detail by referring to the figures, of which

DETAILED DESCRIPTION OF THE INVENTION

Figure 1:
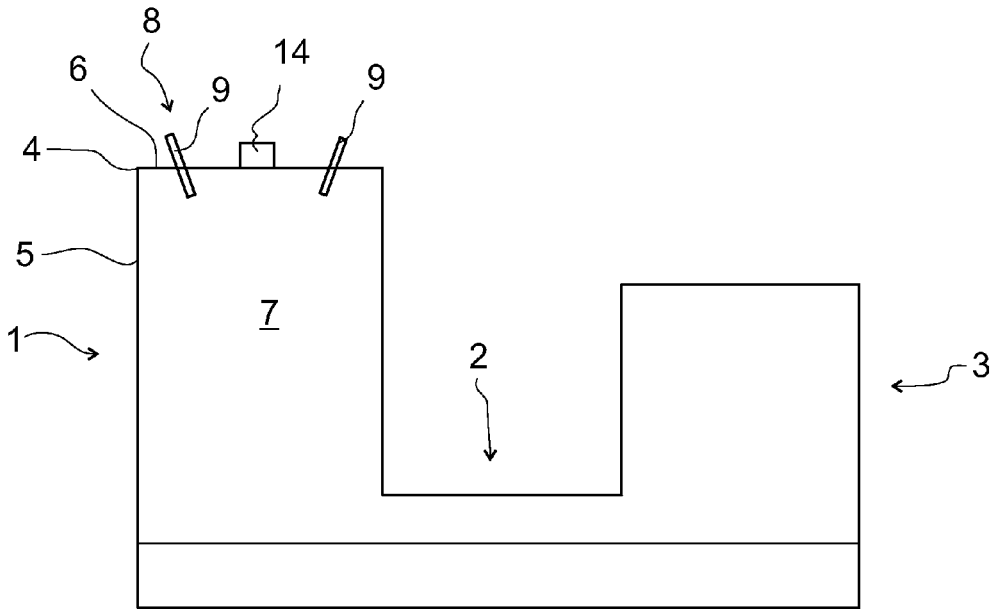
FIG. 1 is a principle drawing of a first embodiment of the suspension smelting furnace.

The figures show ten different embodiments of a suspension smelting furnace.

First the method for controlling the thermal balance of a suspension smelting furnace and preferred embodiments and variations of the method will be described in greater detail.

The suspension smelting furnace comprises a reaction shaft 1, a lower furnace 2, and an uptake 3. The reaction shaft 1 has a shaft structure 4, is provided with a surrounding wall structure 5 and a roof structure 6 and that limits a reaction chamber 7 within the shaft structure 4. The reaction shaft 1 is provided with a concentrate burner 14 for feeding pulverous solid matter and reaction gas into the reaction chamber 7. The basic construction and function principle of a such suspension smelting furnace is known for example from Finnish Patent No. 22,694.

The method comprises a step for providing the shaft structure 4 of the reaction shaft 1 with at least one cooling means 8 for feeding endothermic material (not shown in the drawings) into the reaction chamber 7 of the reaction shaft 1.

The method comprises additionally a step for feeding endothermic material into the reaction chamber 7 of the reaction shaft 1 with at least one cooling means 8.

The method may comprise a step for providing at least one cooling means 8 in the shaft structure 4 at a distance from and separately from the concentrate burner 14.

The method may comprise a step for providing at least one cooling means 8 in the roof structure 6 of the shaft structure 4 at a distance from and separately from the concentrate burner 14.

If the method comprises a step for providing at least one cooling means 8 in the roof structure 6 of the shaft structure 4 at a distance from and separately from the concentrate burner 14, the method may comprise a step for providing at least one cooling means 8 comprising a nozzle 9 in the roof structure 6 of the shaft structure 4 at a distance from and separately from the concentrate burner 14.

If the method comprises a step for providing at least one cooling means 8 comprising a nozzle 9 in the roof structure 6 of the shaft structure 4 at a distance from and separately from the concentrate burner 14, the method may comprise a step for arranging at least on nozzle 9 to feed endothermic material into the reaction chamber 7 of the reaction shaft 1 at an angle between 65 and 85 degrees, for example 70 degrees, with respect to the horizontal plane.

If the method comprises a step for providing at least one cooling means 8 comprising a nozzle 9 in the roof structure 6 of the shaft structure 4 at a distance from and separately from the concentrate burner 14, the method may comprise a step for using at least one such nozzle 9 having a spray angle between 10 and 30 degrees, for example 20 degrees.

The method may comprise a step for providing at least one cooling means 8 in the surrounding wall structure 5 of the shaft structure 4. If the method comprises a step for providing at least one cooling means 8 in the surrounding wall structure 5 of the shaft structure 4, the method may comprise a step for providing at least one cooling means 8 comprising a nozzle 9 in the surrounding wall structure 5 of the shaft structure 4.

If the comprises a step for providing at least one cooling means 8 comprising a nozzle 9 in the surrounding wall structure 5 of the shaft structure 4, the method may comprise a step for arranging at least one such nozzle 9 to feed endothermic material into the reaction chamber 7 of the reaction shaft 1 at an angle of 30 to 60 degrees, preferable 40 to 50 degrees, with respect to the horizontal plane.

If the comprises a step for providing at least one cooling means 8 comprising a nozzle 9 in the surrounding wall structure 5 of the shaft structure 4, the method may comprise a step for arranging at least one such nozzle 9 to feed endothermic material into the reaction chamber 7 of the reaction shaft 1 at a spray angle between 10 and 30 degrees, for example 20 degrees.

The method may comprise a step for providing a suspension smelting furnace having a reaction chamber 7, which cross section area increases towards the lower furnace 2. The reaction chamber 7 can at least partly have the shape of a truncated cone and/or have curved parts. Alternatively, the reaction chamber 7 can have at least partly vertical parts.

Figure 5:
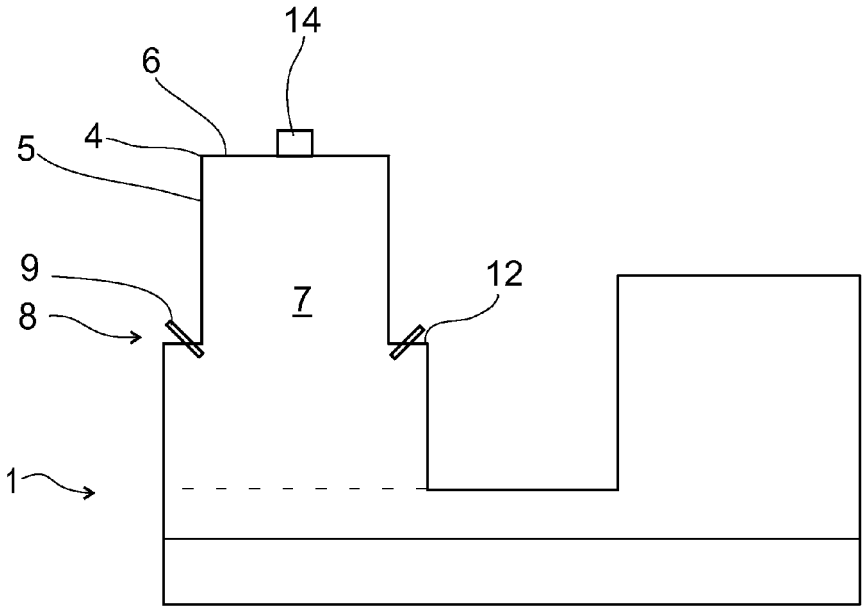
FIG. 5 is a principle drawing of a fifth embodiment of the suspension smelting furnace.
Figure 6:
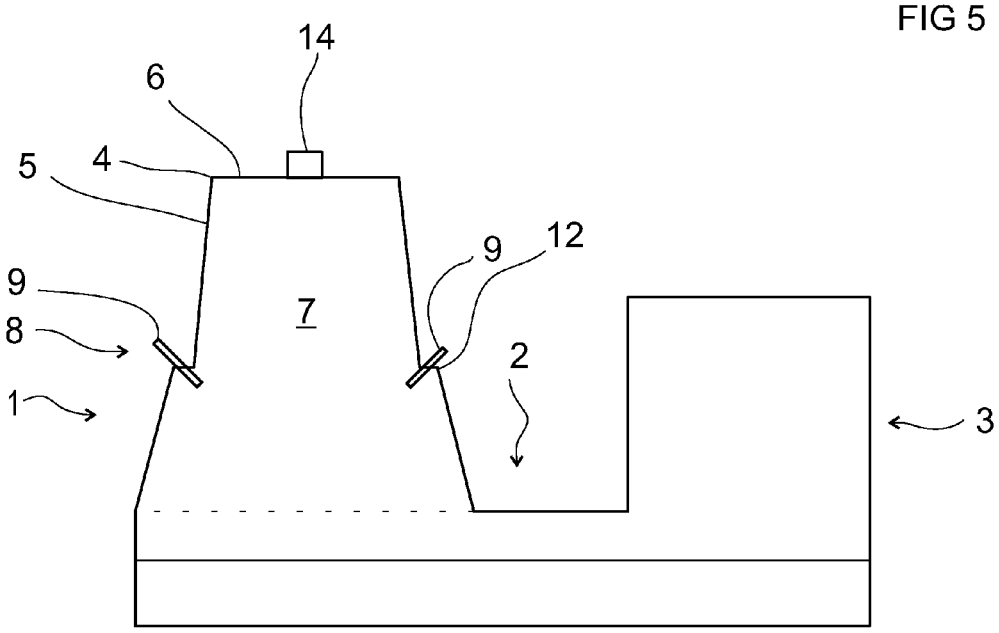
FIG. 6 is a principle drawing of a sixth embodiment of the suspension smelting furnace.

The method may comprise a step for providing a shoulder formation 12 in the surrounding wall structure 5 of the shaft structure 4 and by arranging at least one cooling means 8 in the shoulder formation 12, as shown in FIGS. 5 and 6.

The method may comprise a step for forming a first vertical reaction zone 10 and a second vertical reaction zone 11 in the reaction chamber 7 by providing at least one cooling means 8 in the surrounding wall structure 5 of the shaft structure 4, and a step for by feeding endothermic material into the reaction chamber 7 by means of said at least one cooling means 8 in the surrounding wall structure 5 of the shaft structure 4 to form a first vertical reaction zone 10 free of endothermic material in the reaction chamber 7 and to form a second vertical reaction zone 11 in the reaction chamber 7 below the first vertical reaction zone 10 so that the second vertical reaction zone 11 contains endothermic material.

The method may comprise a step for forming a first vertical reaction zone 10 and a second vertical reaction zone 11 in the reaction chamber 7 by providing at least one cooling means 8 in the surrounding wall structure 5 of the shaft structure 4, and a step for feeding endothermic material into the reaction chamber 7 by means of said at least one cooling means 8 in the surrounding wall structure 5 of the shaft structure 4 to form a first vertical reaction zone 10 in the reaction chamber 7 and to form a second vertical reaction zone 11 in the reaction chamber 7 below the first vertical reaction zone 10 so that the second vertical reaction zone 11 contains more endothermic material than the first vertical reaction zone 10.

The method may comprise a step for forming a first vertical reaction zone 10 and a second vertical reaction zone 11 in the reaction chamber 7 by providing at least one cooling means 8 in the surrounding wall structure 5 of the shaft structure 4, and a step for feeding endothermic material into the reaction chamber 7 by means of said at least one cooling means 8 in the surrounding wall structure 5 of the shaft structure 4 to form a first vertical reaction zone 10 in the reaction chamber 7 and to form a second vertical reaction zone 11 in the reaction chamber 7 below the first vertical reaction zone 10 so that both the first vertical reaction zone 10 and the second vertical reaction zone 11 contains endothermic material.

If the method comprises a step for forming a first vertical reaction zone 10 and a second vertical reaction zone 11 in the reaction chamber 7, the method may comprise a step for providing a shoulder formation 12 between the first vertical reaction zone 10 and the second vertical reaction zone 11.

If the method comprises a step for providing a shoulder formation 12 between the first vertical reaction zone 10 and the second vertical reaction zone 11, the method may comprise a step for providing at least one cooling means 8 in the shoulder formation 12 between the first vertical reaction zone 10 and the second vertical reaction zone 11.

If the method comprises a step for providing at least one cooling means 8 in the shoulder formation 12 between the first vertical reaction zone 10 and the second vertical reaction zone 11, the method may comprise a step for providing at least one cooling means 8 comprising a nozzle 9 in the shoulder formation 12 between the first vertical reaction zone 10 and the second vertical reaction zone 11.

If the method comprises a step for providing at least one cooling means 8 comprising a nozzle 9 in the shoulder formation 12 between the first vertical reaction zone 10 and the second vertical reaction zone 11, the method may comprise a step for arranging at least nozzle 9 to feed endothermic material into the reaction chamber 7 of the reaction shaft 1 at an angle of 30 to 60 degrees, preferable 40 to 50 degrees, with respect to the horizontal plane.

If the method comprises a step for providing at least one cooling means 8 comprising a nozzle 9 in the shoulder formation 12 between the first vertical reaction zone 10 and the second vertical reaction zone 11, the method may comprise a step for arranging at least nozzle 9 to feed endothermic material into the reaction chamber 7 of the reaction shaft 1 at a spray angle between 10 and 30 degrees, for example 20 degrees.

Figure 7:
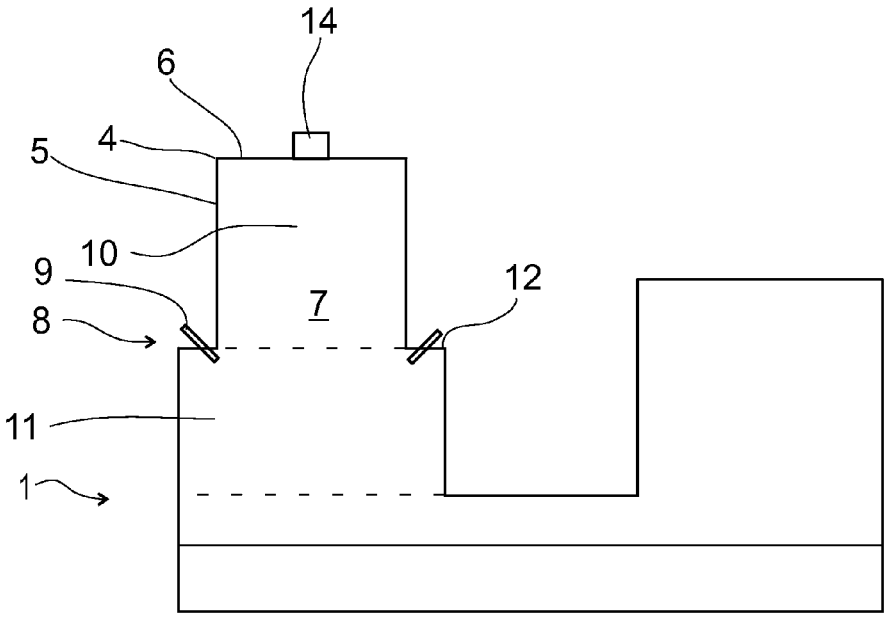
FIG. 7 is a principle drawing of a seventh embodiment of the suspension smelting furnace.
Figure 8:
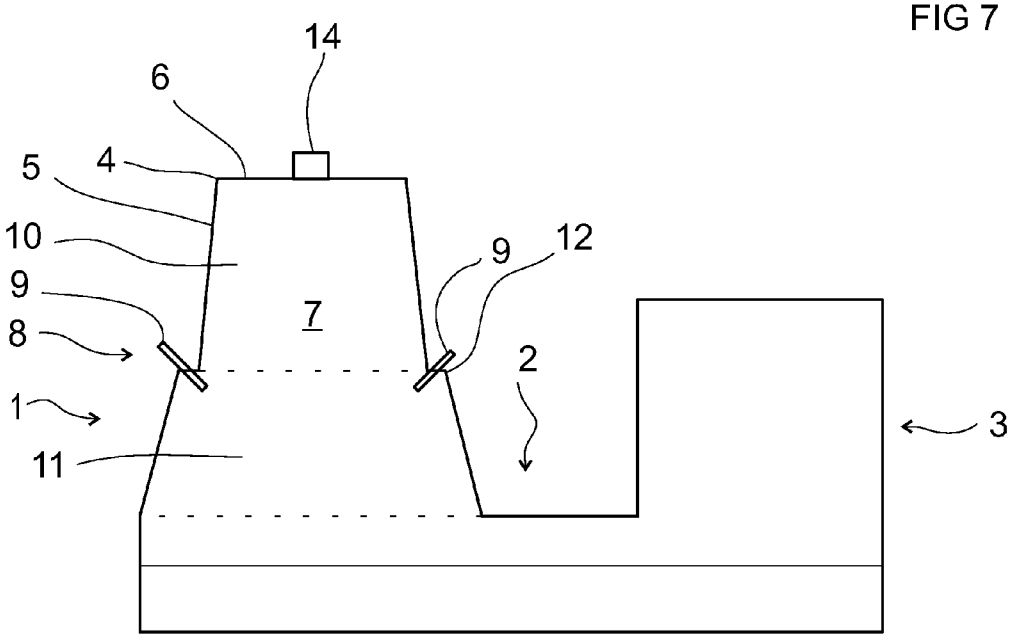
FIG. 8 is a principle drawing of an eight embodiment of the suspension smelting furnace.

If the method comprises a step for forming a first vertical reaction zone 10 and a second vertical reaction zone 11 in the reaction chamber 7, the method may comprise a step for forming the first vertical reaction zone 10 and the second vertical reaction zone 11 so that the average cross section area of the first vertical reaction zone 10 being smaller than the average cross section area of the second vertical reaction zone 11, as shown in FIGS. 7 and 8.

If the method comprises a step for forming a first vertical reaction zone 10 and a second vertical reaction zone 11 in the reaction chamber 7, the method may comprise a step for forming the first vertical reaction zone 10 by the uppermost part of the reaction chamber 7, as shown in FIGS. 7 to 10.

Figure 10:
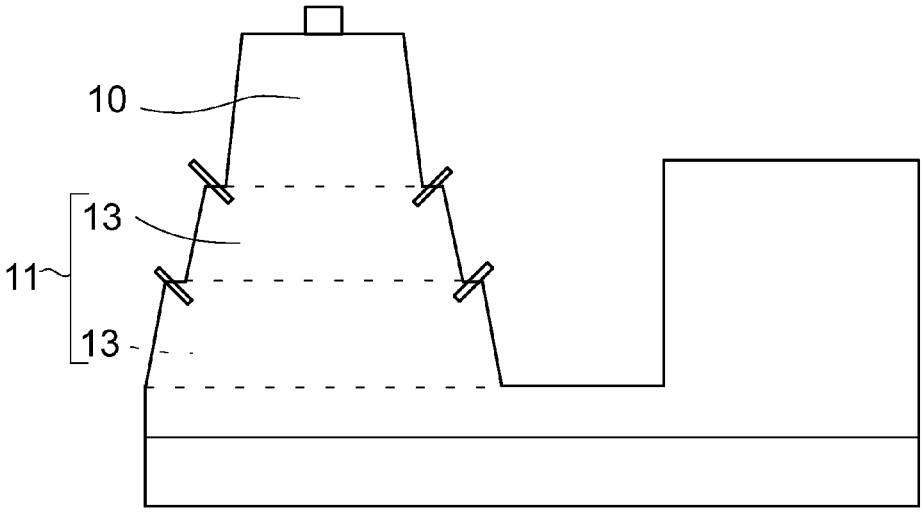
FIG. 10 is a principle drawing of a tenth embodiment of the suspension smelting furnace.

If the method comprises a step for forming a first vertical reaction zone 10 and a second vertical reaction zone 11 in the reaction chamber 7, the method may comprise a step for forming the first vertical reaction zone 10 so that the cross section area of the first vertical reaction zone 10 of the reaction chamber 7 increases towards the lower furnace 2, as shown in FIGS. 8 and 10. The first vertical reaction zone 10 of the reaction chamber 7 can at least partly have the shape of a truncated cone and/or have curved parts. Alternatively, the first vertical reaction zone 10 of the reaction chamber 7 can have at least partly vertical parts.

If the method comprises a step for forming a first vertical reaction zone 10 and a second vertical reaction zone 11 in the reaction chamber 7, the method may comprise a step for forming the second vertical reaction zone 11 so that the cross section area of the second vertical reaction zone 11 of the reaction chamber 7 increases towards the lower furnace 2, as shown in FIG. 8. The second vertical reaction zone 11 of the reaction chamber 7 can at least partly have the shape of a truncated cone and/or have curved parts. Alternatively, the second vertical reaction zone 11 of the reaction chamber 7 can have at least partly vertical parts.

If the method comprises a step for forming a first vertical reaction zone 10 and a second vertical reaction zone 11 in the reaction chamber 7, the method may comprise a step for dividing the second vertical reaction zone 11 into at least two vertical sub-reaction zones 13 by providing cooling means 8 in the surrounding wall structure 5 of the shaft structure 4 at at least two vertically different points of the surrounding wall structure 5 of the shaft structure 4, and a step for feeding endothermic material into the reaction chamber 7 at at least two vertically different points of the surrounding wall structure 5 of the shaft structure 4 to form a first vertical reaction zone 10 free of endothermic material in the reaction chamber 7 and to form at least two vertical sub-reaction zones 13 below the first reaction zone 10 so that the sub-reaction zones 13 contains endothermic material.

If the method comprises a step for forming a first vertical reaction zone 10 and a second vertical reaction zone 11 in the reaction chamber 7, the method may comprise a step for dividing the second vertical reaction zone 11 into at least two vertical sub-reaction zones 13 by providing cooling means 8 in the surrounding wall structure 5 of the shaft structure 4 at at least two vertically different points of the surrounding wall structure 5 of the shaft structure 4, and a step for feeding endothermic material into the reaction chamber 7 at at least two vertically different points of the surrounding wall structure 5 of the shaft structure 4 to form a first vertical reaction zone 10 in the reaction chamber 7 and to form at least two vertical sub-reaction zones 13 below the first reaction zone 10 so that the sub-reaction zones 13 contains more endothermic material than the first reaction zone 10.

If the method comprises a step for forming a first vertical reaction zone 10 and a second vertical reaction zone 11 in the reaction chamber 7, the method may comprise a step for dividing the second vertical reaction zone 11 into at least two vertical sub-reaction zones 13 by providing cooling means 8 in the surrounding wall structure 5 of the shaft structure 4 at at least two vertically different points of the surrounding wall structure 5 of the shaft structure 4, and a step for feeding endothermic material into the reaction chamber 7 at at least two vertically different points of the surrounding wall structure 5 of the shaft structure 4 to form a first vertical reaction zone 10 in the reaction chamber 7 and to form at least two vertical sub-reaction zones 13 below the first reaction zone 10, so that both the first vertical reaction zone 10 and the sub-reaction zones 13 contains endothermic material.

Figure 9:
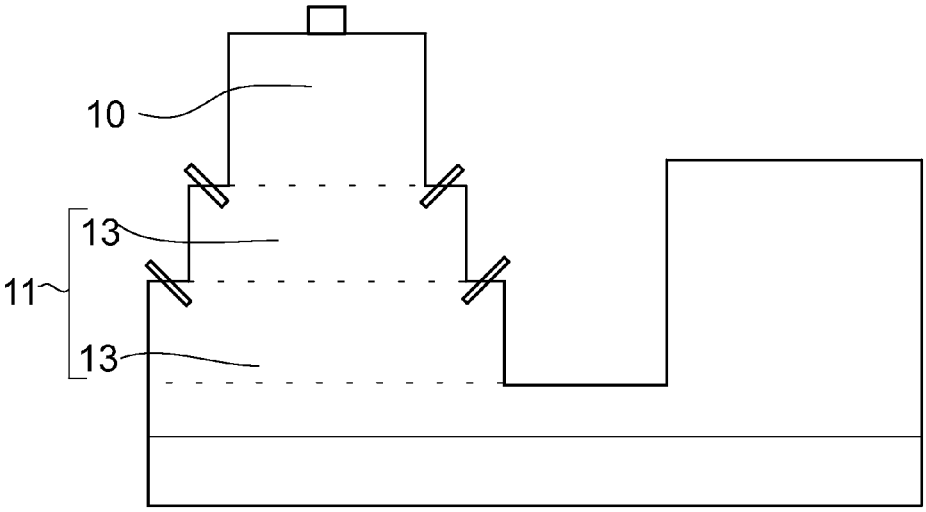
FIG. 9 is a principle drawing of a ninth embodiment of the suspension smelting furnace.

FIGS. 9 and 10 shows embodiments where two vertical sub-reaction zones 13 have been formed.

If the method comprises a step for dividing the second vertical reaction zone 11 into several vertical sub-reaction zones 13, the method may comprise a step for forming a shoulder formation 12 between two adjacent vertical sub-reaction zones 13.

If the method comprises a step for forming a shoulder formation 12 between two adjacent vertical sub-reaction zones 13, the method may comprise a step for providing at least one cooling means 8 in the shoulder formation 12 between two adjacent vertical sub-reaction zones 13.

If the method comprises a step for providing at least one cooling means 8 in the shoulder formation 12 between two adjacent vertical sub-reaction zones 13, the method may comprise a step for providing at least one cooling means 8 comprising a nozzle 9.

If the method comprises a step for providing at least one cooling means 8 comprising a nozzle 9 in a shoulder formation 12 between two adjacent vertical sub-reaction zones 13, the method may comprise a step for arranging the nozzle 9 to feed endothermic material into the reaction chamber 7 of the reaction shaft 1 at an angle of 30 to 60 degrees, preferable 40 to 50 degrees, with respect to the horizontal plane.

If the method comprises a step for providing at least one cooling means 8 comprising a nozzle 9 in a shoulder formation 12 between two adjacent vertical sub-reaction zones 13, the method may comprise a step for arranging at least nozzle 9 to feed endothermic material into the reaction chamber 7 of the reaction shaft 1 at a spray angle between 10 and 30 degrees, for example 20 degrees.

If the method comprises a step for dividing the second vertical reaction zone 11 into several vertical sub-reaction zones 13, the method may comprise a step for forming a vertical sub-reaction zone 13 which cross-section area increases towards the lower furnace 2, as shown in FIG. 9. It is for example possible to provide a vertical sub-reaction zone 13 having at least partly have the shape of a truncated cone and/or having curved parts. Alternatively, the first vertical reaction zone 10 of the reaction chamber 7 can have at least partly vertical parts.

The method may comprise a step for by providing at least one cooling means 8 at a distance 0.3 h to 0.7 h preferably at a distance 0.4 h to 0.6 h measured from the roof structure 6 of the reaction chamber 7, where h is the height of the reaction chamber 7.

The method may comprise a step for by providing at least one cooling means 8 having a nozzle 9 that is arranged to feed endothermic material into the reaction chamber 7 so that a flow of endothermic material cuts an imaginary vertical central line of the reaction chamber 7 at a distance 0.3 h to 0.7 h preferably at a distance 0.4 h to 0.6 h measured from the roof structure 6 of the reaction chamber 7, where h is the height of the reaction chamber 7.

The method may comprise a step for providing several cooling means 8 at the same level of the reaction chamber 7 and evenly around the reaction chamber 7.

In the method at least one of the following is preferably, but not necessarily, used as endothermic material: Water, waste water such as municipal waste water, acid of different strengths, such as sulphuric acid or weak acid, lime water, metallic salt and metallic sulphate, such as copper sulphate or nickel sulphate or as a combination of the above. The endothermic material can also be in the form of an oversaturated solution, where the maximum degree of oversaturation depends on the properties of the material in the solution.

In the method, the endothermic material may be fed into the reaction chamber 7 by means of the cooling means 8 in the form of droplets. The size of such droplets is preferably, but not necessarily, selected so that the droplets are broken down and so that the endothermic material of the droplets is vaporized prior the material enters the lower furnace. On the other hand, the size of such droplets may not be so small that the droplets are broken down too early in the in the reaction chamber 7, because this reduces the ability of the droplets to endothermically consume energy in the hottest part of the reaction chamber 7, the hottest part being close to an imaginary vertical centre axis of the reaction chamber 7.

The method may comprise feeding endothermic material additionally to pulverous solid matter that is fed into the reaction shaft 1 by means of the concentrate burner 14 and additionally to reaction gas that is fed into the reaction shaft 1 by means of the concentrate burner 14.

The method may comprise using endothermic material in the form of fluid, preferably in the form of liquid.

The method may comprise providing at least one cooling means 8 at a level of at least 0.3 h measured from the lower end of the reaction chamber 7, where h is the height of the reaction chamber 7. This provides for feeding endothermic material at a such level i.e. height of the reaction chamber 7 which allows for consuming of thermal energy in the reaction chamber 7 by means of the endothermic material.

Next the suspension smelting furnace and preferred embodiments and variations of the suspension smelting furnace will be described in greater detail.

The suspension smelting furnace comprises a reaction shaft 1, a lower furnace 2, and an uptake 3. The reaction shaft 1 has a shaft structure 4 that is provided with a surrounding wall structure 5 and a roof structure 6 and that limits a reaction chamber 7. The reaction shaft 1 is provided with a concentrate burner 14 for feeding pulverous solid matter and reaction gas into the reaction chamber 7.

The shaft structure 4 of the reaction shaft 1 is provided with cooling means 8 for feeding endothermic material into the reaction chamber 7 of the reaction shaft 1.

The suspension smelting furnace may comprise at least one cooling means 8 in the shaft structure 4 at a distance from and separately from the concentrate burner 14.

The suspension smelting furnace may comprise at least one cooling means 8 in the roof structure 6 of the shaft structure 4 at a distance from and separately from the concentrate burner 14.

If the suspension smelting furnace comprises at least one cooling means 8 in the roof structure 6 of the shaft structure 4 at a distance from and separately from the concentrate burner 14, the suspension smelting furnace may comprise at least one cooling means 8 in the roof structure 6 of the shaft structure 4 at a distance from and separately from the concentrate burner 14 that comprises a nozzle 9.

It the suspension smelting furnace comprise at least one cooling means 8 in the roof structure 6 of the shaft structure 4 at a distance from and separately from the concentrate burner 14 that comprises a nozzle 9, the nozzle 9 may be arranged to feed endothermic material into the reaction chamber 7 of the reaction shaft 1 at an angle of 30 to 70 degrees with respect to the horizontal plane.

It the suspension smelting furnace comprise at least one cooling means 8 in the roof structure 6 of the shaft structure 4 at a distance from and separately from the concentrate burner 14 that comprises a nozzle 9, the nozzle 9 may be arranged to feed endothermic material into the reaction chamber 7 of the reaction shaft 1 at a spray angle between 10 and 30 degrees, for example 20 degrees.

The suspension smelting furnace may comprise at least one cooling means 8 in the surrounding wall structure 5 of the shaft structure 4.

If the suspension smelting furnace comprises at least one cooling means 8 in the surrounding wall structure 5 of the shaft structure 4, the suspension smelting furnace may comprise at least one cooling means 8 in the surrounding wall structure 5 of the shaft structure 4 that comprises a nozzle 9.

If the suspension smelting furnace comprises at least one cooling means 8 in the surrounding wall structure 5 of the shaft structure 4 that comprises a nozzle 9, the nozzle 9 may be arranged to feed endothermic material into the reaction chamber 7 of the reaction shaft 1 at an angle of 30 to 60 degrees, preferable 40 to 50 degrees, with respect to the horizontal plane.

If the suspension smelting furnace comprises at least one cooling means 8 in the surrounding wall structure 5 of the shaft structure 4 that comprises a nozzle 9, the nozzle 9 may be arranged to feed endothermic material into the reaction chamber 7 of the reaction shaft 1 at a spray angle between 10 and 30 degrees, for example 20 degree.

Figure 2:
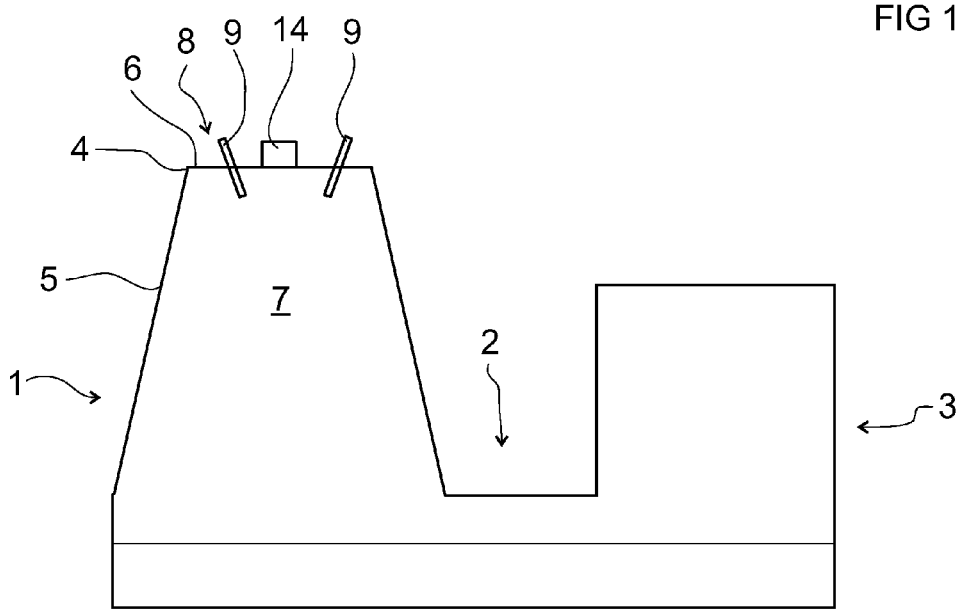
FIG. 2 is a principle drawing of a second embodiment of the suspension smelting furnace.
Figure 3:
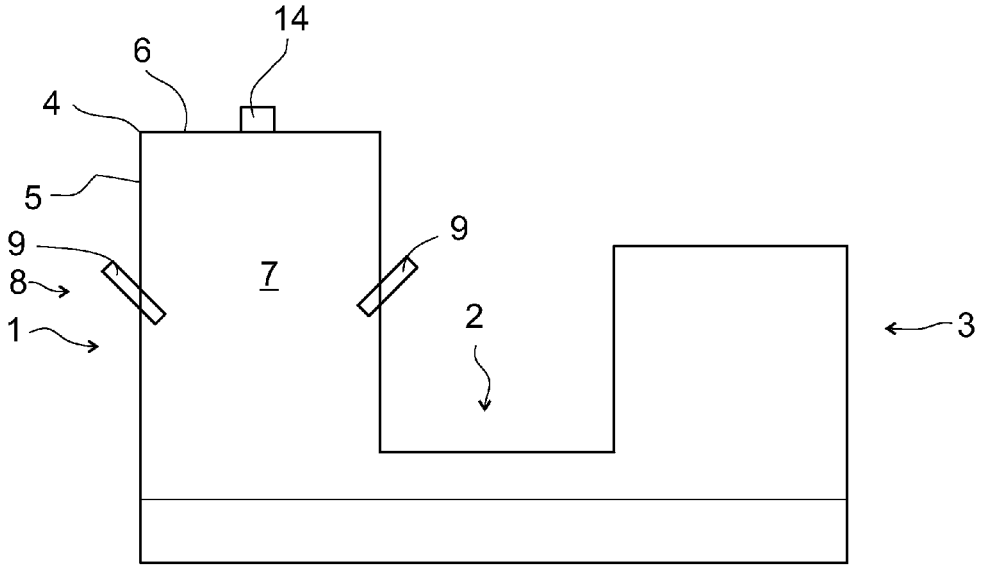
FIG. 3 is a principle drawing of a third embodiment of the suspension smelting furnace.
Figure 4:
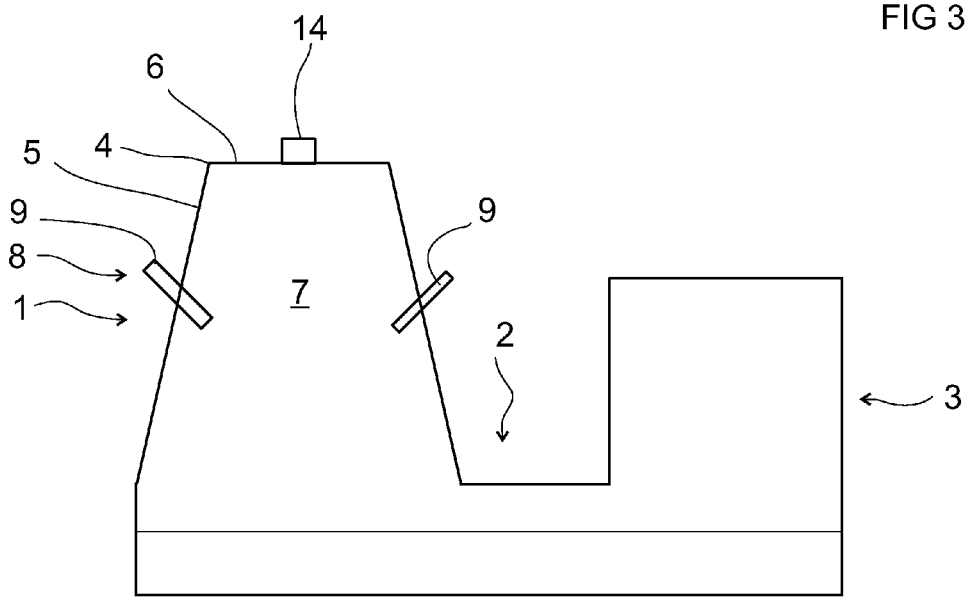
FIG. 4 is a principle drawing of a fourth embodiment of the suspension smelting furnace.

The cross section area of the reaction chamber 7 may increase towards the lower furnace 2, as shown in FIGS. 2 and 4. The reaction chamber 7 can at least partly have the shape of a truncated cone and/or have curved parts. Alternatively, the reaction chamber 7 can have at least partly vertical parts, as shown in FIGS. 1 and 3.

The reaction chamber 7 may comprise a shoulder formation 12 in the surrounding wall structure 5 of the shaft structure 4 and by at least one cooling means 8 in the shoulder formation 12.

The reaction chamber 7 may comprise a first vertical reaction zone 10 and a second vertical reaction zone 11 below the first vertical reaction zone 10 so that at least one cooling means 8 is arranged in the surrounding wall structure 5 of the shaft structure 4 and is arranged to feed endothermic material into the reaction chamber 7 so that the second vertical reaction zone 11 contains endothermic material and so that the first vertical reaction zone 10 is free of endothermic material.

The reaction chamber 7 may comprise a first vertical reaction zone 10 and a second vertical reaction zone 11 below the first vertical reaction zone 10 so that at least one cooling means 8 is arranged in the surrounding wall structure 5 of the shaft structure 4 and is arranged to feed endothermic material into the reaction chamber 7 so that the second vertical reaction zone 11 contains more endothermic material than the first vertical reaction zone 10.

The reaction chamber 7 may comprise a first vertical reaction zone 10 and a second vertical reaction zone 11 below the first vertical reaction zone 10 so that at least one cooling means 8 is arranged in the surrounding wall structure 5 of the shaft structure 4 and is arranged to feed endothermic material into the reaction chamber 7 so that both the first vertical reaction zone 10 and the second vertical reaction zone 11 contains endothermic material.

If the reaction chamber 7 comprises a first vertical reaction zone 10 and a second vertical reaction zone 11, the reaction chamber 7 may comprise a shoulder formation 12 between the first vertical reaction zone 10 and the second vertical reaction zone 11, as shown in FIGS. 7 to 10.

If the reaction chamber 7 comprises a shoulder formation 12 between the first vertical reaction zone 10 and the second vertical reaction zone 11, at least one cooling means 8 may be provided in the shoulder formation 12 between the first vertical reaction zone 10 and the second vertical reaction zone 11, as shown in FIGS. 7 to 10.

If at least one cooling means 8 is provided in a shoulder formation 12 between the first vertical reaction zone 10 and the second vertical reaction zone 11, the suspension smelting furnace may comprise at least one cooling means 8 in the shoulder formation 12 between the first vertical reaction zone 10 and the second vertical reaction zone 11 that comprises a nozzle 9.

If the reaction chamber 7 comprises at least one cooling means 8 in a shoulder formation 12 between the first vertical reaction zone 10 and the second vertical reaction zone 11 that comprises a nozzle 9, the nozzle 9 may be arranged to feed endothermic material into the reaction chamber 7 of the reaction shaft 1 at an angle of 30 to 60 degrees, preferable 40 to 50 degrees, with respect to the horizontal plane.

If the reaction chamber 7 comprises at least one cooling means 8 in a shoulder formation 12 between the first vertical reaction zone 10 and the second vertical reaction zone 11 that comprises a nozzle 9, the nozzle 9 may be arranged to feed endothermic material into the reaction chamber 7 of the reaction shaft 1 at a spray angle between 10 and 30 degrees, for example 20 degrees.

If the reaction chamber 7 comprises a first vertical reaction zone 10 and a second vertical reaction zone 11, the average cross section area of the first vertical reaction zone 10 may be smaller than the average cross section area of the second vertical reaction zone 11, as shown in FIGS. 7 and 8.

If the reaction chamber 7 comprises a first vertical reaction zone 10 and a second vertical reaction zone 11, the first vertical reaction zone 10 may be formed by the uppermost part of the reaction chamber 7, as shown in FIGS. 7 and 8.

If the reaction chamber 7 comprises a first vertical reaction zone 10 and a second vertical reaction zone 11, the cross section area of the first vertical reaction zone 10 of the reaction chamber 7 may increase towards the lower furnace 2, as shown in FIG. 8. The first vertical reaction zone 10 of the reaction chamber 7 can at least partly have the shape of a truncated cone and/or have curved parts. Alternatively, the first vertical reaction zone 10 of the reaction chamber 7 can have at least partly vertical parts, as shown in FIG. 8.

If the reaction chamber 7 comprises a first vertical reaction zone 10 and a second vertical reaction zone 11, the cross section area of the second vertical reaction zone 11 of the reaction chamber 7 increasing towards the lower furnace 2, as shown in FIG. 8. The second vertical reaction zone 11 of the reaction chamber 7 can at least partly have the shape of a truncated cone and/or have curved parts. Alternatively, the second vertical reaction zone 11 of the reaction chamber 7 can have at least partly vertical parts, as shown in FIG. 8.

If the reaction chamber 7 comprises a first vertical reaction zone 10 and a second vertical reaction zone 11, the second vertical reaction zone 11 may be divided into at least two vertical sub-reaction zones 13 so that cooling means 8 are arranged to feed endothermic material into the reaction chamber 7 at at least two vertically different points of the surrounding wall structure 5 of the shaft structure 4 to form a first vertical reaction zone 10 free of endothermic material in the reaction chamber 7 and to form at least two vertical sub-reaction zones 13 below the first vertical reaction zone 10 so that the at least two vertical sub-reaction zones 13 contains endothermic material.

If the reaction chamber 7 comprises a first vertical reaction zone 10 and a second vertical reaction zone 11, the second vertical reaction zone 11 may be divided into at least two vertical sub-reaction zones 13 so that cooling means 8 are arranged to feed endothermic material into the reaction chamber 7 at at least two vertically different points of the surrounding wall structure 5 of the shaft structure 4 to form a first vertical reaction zone 10 in the reaction chamber 7 and to form at least two vertical sub-reaction zones 13 below the first vertical reaction zone 10 so that the at least two vertical sub-reaction zones 13 contains more endothermic material than the first vertical reaction zone 10.

If the reaction chamber 7 comprises a first vertical reaction zone 10 and a second vertical reaction zone 11, the second vertical reaction zone 11 may be divided into at least two vertical sub-reaction zones 13 so that cooling means 8 are arranged to feed endothermic material into the reaction chamber 7 at at least two vertically different points of the surrounding wall structure 5 of the shaft structure 4 to form a first vertical reaction zone 10 in the reaction chamber 7 and to form at least two vertical sub-reaction zones 13 below the first vertical reaction zone 10 so that both the first vertical reaction zone 10 and the at least two vertical sub-reaction zones 13 contains endothermic material.

If the second vertical reaction zone 11 is divided into several vertical sub-reaction zones 13, the second vertical reaction zone 11 may comprise a shoulder formation 12 between two adjacent vertical sub-reaction zones 13.

If the second vertical reaction zone 11 comprises a shoulder formation 12 between two adjacent vertical sub-reaction zones 13, at least one cooling means 8 may be provided in the shoulder formation 12 between two adjacent vertical sub-reaction zones 13.

If at least one cooling means 8 is provided in a shoulder formation 12 between two adjacent vertical sub-reaction zones 13, the suspension smelting furnace may comprise at least one cooling means 8 comprising a nozzle 9. In this case there may be a nozzle that is arranged to feed endothermic material into the reaction chamber 7 of the reaction shaft 1 at an angle of 30 to 60 degrees, preferable 40 to 50 degrees, with respect to the horizontal plane. In this case there may be a nozzle that is arranged to feed endothermic material into the reaction chamber 7 of the reaction shaft 1 at a spray angle between 10 and 30 degrees, for example 20 degrees.

If the second vertical reaction zone 11 is divided into several vertical sub-reaction zones 13, the suspension smelting furnace may comprise a vertical sub-reaction zone 13 which cross-section area increases towards the lower furnace 2, as shown in FIG. 10. It is for example possible to have vertical sub-reaction zone 13 having at least partly have the shape of a truncated cone and/or having curved parts. Alternatively, the first vertical reaction zone 10 of the reaction chamber 7 can have at least partly vertical parts.

The suspension smelting furnace may comprise at least one cooling means 8 that is arranged at a distance 0.3 h to 0.7 h preferably at a distance 0.4 h to 0.6 h measured from the roof structure 6 of the reaction chamber 7, where h is the height of the reaction chamber 7.

The suspension smelting furnace may comprise several cooling means 8, which are arranged at the same level of the reaction chamber 7 and which are distributed evenly around the reaction chamber 7.

The suspension smelting furnace may comprise at least one cooling means 8 having a nozzle 9 that is arranged to feed endothermic material into the reaction chamber 7 so that a flow of endothermic material cuts an imaginary vertical central line of the reaction chamber 7 at a distance 0.3 h to 0.7 h preferably at a distance 0.4 h to 0.6 h measured from the roof structure 6 of the reaction chamber 7, where h is the height of the reaction chamber 7. The suspension smelting furnace may comprise at least one cooling means 8 having a nozzle 9 that is arranged to feed endothermic material into the hottest point of the reaction chamber 7, i.e. to the middle of the reaction chamber 7.

The suspension smelting furnace comprises preferably, but not necessarily, at least one cooling means 8 that is arranged to feed at least one of the following as endothermic material: water, waste water such as municipal waste water, acid of different strengths, such as sulphuric acid or weak acid, lime water, metallic salt and metallic sulphate, such as copper sulphate or nickel sulphate or as a combination of the above. The endothermic material can also be in the form of an oversaturated solution, where the maximum degree of oversaturation depends on the properties of the material in the solution.

In the suspension smelting furnace, the endothermic material may be fed into the reaction chamber 7 by means of the cooling means 8 in the form of droplets. The size of such droplets is preferably, but not necessarily, selected so that the droplets are broken down and vaporized in the optimum location of the reaction chamber 7.

The suspension smelting furnace may comprise at least one cooling means 8 that is arranged to feed feeding endothermic material additionally to pulverous solid matter that is fed into the reaction shaft 1 by means of the concentrate burner 14 and additionally to reaction gas that is fed into the reaction shaft 1 by means of the concentrate burner 14.

The suspension smelting furnace may comprise at least one cooling means 8 that is arranged to feed using endothermic material in the form of fluid, preferably in the form of liquid.

The suspension smelting furnace may comprise at least one cooling means 8 arranged at a level of at least 0.3 h measured from the lower end of the reaction chamber 7, where h is the height of the reaction chamber 7. This provides for feeding endothermic material at a such level i.e. height of the reaction chamber 7 which allows for consuming of thermal energy in the reaction chamber 7 by means of the endothermic material.

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. Method for controlling the thermal balance of a suspension smelting comprising a reaction shaft, a lower furnace, and an uptake, wherein the reaction shaft having a shaft structure that is provided with a surrounding wall structure and a roof structure at the upper end of the surrounding wall structure and that limits a reaction chamber within the shaft structure, said reaction chamber having a lower end in communication with the lower furnace, and wherein the reaction shaft is provided with a concentrate burner for feeding pulverous solid matter and reaction gas into the reaction chamber, comprising:

providing the shaft structure of the reaction shaft with at least one cooling means for feeding endothermic material into the reaction chamber of the reaction shaft, feeding endothermic material into the reaction chamber of the reaction shaft with at least one cooling means, and providing at least one cooling means at a level of at least 0.3 h measured from the lower end of the reaction chamber, where h is the height of the reaction chamber.

2. The method according to claim 1, comprising providing at least one cooling means in the shaft structure at a distance from and separately from the concentrate burner.

3. The method according to claim 1, comprising providing at least one cooling means in the roof structure of the shaft structure at a distance from and separately from the concentrate burner.

4. The method according to claim 3, comprising providing at least one cooling means comprising a nozzle, and arranging the nozzle to feed endothermic material into the reaction chamber of the reaction shaft at an angle of 65 to 85 degrees with respect to the horizontal plane.

5. The method according to claim 1, comprising providing at least one cooling means in the surrounding wall structure of the shaft structure.

6. The method according to claim 5, comprising providing at least one cooling means comprising a nozzle, and arranging the nozzle to feed endothermic material into the reaction chamber of the reaction shaft at an angle of 30 to 60 degrees, with respect to the horizontal plane.

7. The method according to claim 1, comprising providing a shoulder formation in the surrounding wall structure of the shaft structure and by arranging at least one cooling means in the shoulder formation.

8. A method for controlling the thermal balance of a suspension smelting comprising a reaction shaft, a lower furnace, and an uptake, wherein the reaction shaft having a shaft structure that is provided with a surrounding wall structure and a roof structure at the upper end of the surrounding wall structure and that limits a reaction chamber within the shaft structure, said reaction chamber having a lower end in communication with the lower furnace, and wherein the reaction shaft is provided with a concentrate burner for feeding pulverous solid matter and reaction gas into the reaction chamber, comprising:

providing the shaft structure of the reaction shaft with at least one cooling means for feeding endothermic material into the reaction chamber of the reaction shaft, feeding endothermic material into the reaction chamber of the reaction shaft with at least one cooling means, providing at least one cooling means at a level of at least 0.3 h measured from the lower end of the reaction chamber, where h is the height of the reaction chamber:

forming a first vertical reaction zone and a second vertical reaction zone in the reaction chamber by providing at least one cooling means in the surrounding wall structure of the shaft structure, and feeding endothermic material into the reaction chamber by means of said at least one cooling means in the surrounding wall structure of the shaft structure to form a first vertical reaction zone free of endothermic material in the reaction chamber and to form a second vertical reaction zone in the reaction chamber below the first vertical reaction zone, wherein the second vertical reaction zone containing endothermic material.

9. A method for controlling the thermal balance of a suspension smelting comprising a reaction shaft, a lower furnace, and an uptake, wherein the reaction shaft having a shaft structure that is provided with a surrounding wall structure and a roof structure at the upper end of the surrounding wall structure and that limits a reaction chamber within the shaft structure, said reaction chamber having a lower end in communication with the lower furnace, and wherein the reaction shaft is provided with a concentrate burner for feeding pulverous solid matter and reaction gas into the reaction chamber, comprising;

providing the shaft structure of the reaction shaft with at least one cooling means for feeding endothermic material into the reaction chamber of the reaction shaft, feeding endothermic material into the reaction chamber of the reaction shaft with at least one cooling means, providing at least one cooling means at a level of at least 0.3 h measured from the lower end of the reaction chamber, where h is the height of the reaction chamber;

forming a first vertical reaction zone and a second vertical reaction zone in the reaction chamber by providing at least one cooling means in the surrounding wall structure of the shaft structure, and feeding endothermic material into the reaction chamber by means of said at least one cooling means in the surrounding wall structure of the shaft structure to form a first vertical reaction zone in the reaction chamber and to form a second vertical reaction zone in the reaction chamber below the first vertical reaction zone, wherein the second vertical reaction zone containing more endothermic material than the first vertical reaction zone.

10. A method for controlling the thermal balance of a suspension smelting comprising a reaction shaft, a lower furnace, and an uptake, wherein the reaction shaft having a shaft structure that is provided with a surrounding wall structure and a roof structure at the upper end of the surrounding wall structure and that limits a reaction chamber within the shaft structure, said reaction chamber having a lower end in communication with the lower furnace, and wherein the reaction shaft is provided with a concentrate burner for feeding pulverous solid matter and reaction gas into the reaction chamber, comprising:

providing the shaft structure of the reaction shaft with at least one cooling means for feeding endothermic material into the reaction chamber of the reaction shaft, feeding endothermic material into the reaction chamber of the reaction shaft with at least one cooling means, providing at least one cooling means at a level of at least 0.3 h measured from the lower end of the reaction chamber, where h is the height of the reaction chamber;

forming a first vertical reaction zone and a second vertical reaction zone in the reaction chamber by providing at least one cooling means in the surrounding wall structure of the shaft structure, feeding endothermic material into the reaction chamber by means of said at least one cooling means in the surrounding wall structure of the shaft structure to form a first vertical reaction zone in the reaction chamber and to form a second vertical reaction zone in the reaction chamber below the first vertical reaction zone, providing a shoulder formation between the first vertical reaction zone and the second vertical reaction zone, and providing at least one cooling means in the shoulder formation between the first vertical reaction zone and the second vertical reaction zone.

11. A method for controlling the thermal balance of a suspension smelting comprising a reaction shaft, a lower furnace, and an uptake, wherein the reaction shaft having a shaft structure that is provided with a surrounding wall structure and a roof structure at the upper end of the surrounding wall structure and that limits a reaction chamber within the shaft structure, said reaction chamber having a lower end in communication with the lower furnace, and wherein the reaction shaft is provided with a concentrate burner for feeding pulverous solid matter and reaction gas into the reaction chamber, comprising:

providing the shaft structure of the reaction shaft with at least one cooling means for feeding endothermic material into the reaction chamber of the reaction shaft, feeding endothermic material into the reaction chamber of the reaction shaft with at least one cooling means, providing at least one cooling means at a level of at least 03 h measured from the lower end of the reaction chamber, where h is the height of the reaction chamber;

forming a first vertical reaction zone and a second vertical reaction zone in the reaction chamber by providing at least one cooling means in the surrounding wall structure of the shaft structure, feeding endothermic material into the reaction chamber by means of said at least one cooling means in the surrounding wall structure of the shaft structure to form a first vertical reaction zone in the reaction chamber and to form a second vertical reaction zone in the reaction chamber below the first vertical reaction zone, providing at least one cooling means comprising a nozzle, and arranging the nozzle to feed endothermic material into the reaction chamber of the reaction shaft at an angle of 30 to 60 degrees, preferable 40 to 50 degrees, with respect to the horizontal plane.

12. A method for controlling the thermal balance of a suspension smelting comprising a reaction shaft, a lower furnace, and an uptake, wherein the reaction shaft having a shaft structure that is provided with a surrounding wall structure and a roof structure at the upper end of the surrounding wall structure and that limits a reaction chamber within the shaft structure, said reaction chamber having a lower end in communication with the lower furnace, and wherein the reaction shaft is provided with a concentrate burner for feeding pulverous solid matter and reaction gas into the reaction chamber, comprising:

providing the shaft structure of the reaction shaft with at least one cooling means for feeding endothermic material into the reaction chamber of the reaction shaft, feeding endothermic material into the reaction chamber of the reaction shaft with at least one cooling means, providing at least one cooling means at a level of at least 0.3 h measured from the lower end of the reaction chamber, where h is the height of the reaction chamber;

forming a first vertical reaction zone and a second vertical reaction zone in the reaction chamber by providing at least one cooling means in the surrounding wall structure of the shaft structure, feeding endothermic material into the reaction chamber by means of said at least one cooling means in the surrounding wall structure of the shaft structure to form a first vertical reaction zone in the reaction chamber and to form a second vertical reaction zone in the reaction chamber below the first vertical reaction zone, forming the first vertical reaction zone and the second vertical reaction zone so that the average cross section area of the first vertical reaction zone being smaller than the average cross section area of the second vertical reaction zone.

13. A method for controlling the thermal balance of a suspension smelting comprising a reaction shaft, a lower furnace, and an uptake, wherein the reaction shaft having a shaft structure that is provided with a surrounding wall structure and a roof structure at the upper end of the surrounding wall structure and that limits a reaction chamber within the shaft structure, said reaction chamber having a lower end in communication with the lower furnace, and wherein the reaction shaft is provided with a concentrate burner for feeding pulverous solid matter and reaction gas into the reaction chamber, comprising:

providing the shaft structure of the reaction shaft with at least one cooling means for feeding endothermic material into the reaction chamber of the reaction shaft, feeding endothermic material into the reaction chamber of the reaction shaft with at least one cooling means, providing at least one cooling means at a level of at least 0.3 h measured from the lower end of the reaction chamber, where h is the height of the reaction chamber;

forming a first vertical reaction zone and a second vertical reaction zone in the reaction chamber by providing at least one cooling means in the surrounding wall structure of the shaft structure, feeding endothermic material into the reaction chamber by means of said at least one cooling means in the surrounding wall structure of the shaft structure to form a first vertical reaction zone in the reaction chamber and to form a second vertical reaction zone in the reaction chamber below the first vertical reaction zone, and forming the first vertical reaction zone by the uppermost part of the reaction chamber.

14. A method for controlling the thermal balance of a suspension smelting comprising a reaction shaft, a lower furnace, and an uptake, wherein the reaction shaft having a shaft structure that is provided with a surrounding wall structure and a roof structure at the upper end of the surrounding wall structure and that limits a reaction chamber within the shaft structure, said reaction chamber having a lower end in communication with the lower furnace, and wherein the reaction shaft is provided with a concentrate burner for feeding pulverous solid matter and reaction gas into the reaction chamber, comprising:

providing the shaft structure of the reaction shaft with at least one cooling means for feeding endothermic material into the reaction chamber of the reaction shaft, feeding endothermic material into the reaction chamber of the reaction shaft with at least one cooling means, providing at least one cooling means at a level of at least 0.3 h measured from the lower end of the reaction chamber, where h is the height of the reaction chamber;

forming a first vertical reaction zone and a second vertical reaction zone in the reaction chamber by providing at least one cooling means in the surrounding wall structure of the shaft structure, feeding endothermic material into the reaction chamber by means of said at least one cooling means in the surrounding wall structure of the shaft structure to form a first vertical reaction zone in the reaction chamber and to form a second vertical reaction zone in the reaction chamber below the first vertical reaction zone, dividing the second vertical reaction zone into at least two vertical sub-reaction zones by providing cooling means in the surrounding wall structure of the shaft structure at least two vertically different points of the surrounding wall structure of the shaft structure, and feeding endothermic material into the reaction chamber at least two vertically different points of the surrounding wall structure of the shaft structure to form a first vertical reaction zone free of endothermic material in the reaction chamber and to form at least two vertical sub-reaction zones below the first reaction zone, wherein the sub-reaction zones containing endothermic material.

15. A method for controlling the thermal balance of a suspension smelting comprising a reaction shaft, a lower furnace, and an uptake, wherein the reaction shaft having a shaft structure that is provided with a surrounding wall structure and a roof structure at the upper end of the surrounding wall structure and that limits a reaction chamber within the shaft structure, said reaction chamber having a lower end in communication with the lower furnace, and wherein the reaction shaft is provided with a concentrate burner for feeding pulverous solid matter and reaction gas into the reaction chamber, comprising:

providing the shaft structure of the reaction shaft with at least one cooling means for feeding endothermic material into the reaction chamber of the reaction shaft, feeding endothermic material into the reaction chamber of the reaction shaft with at least one cooling means, providing at least one cooling means at a level of at least 0.3 h measured from the lower end of the reaction chamber, where h is the height of the reaction chamber;

forming a first vertical reaction zone and a second vertical reaction zone in the reaction chamber by providing at least one cooling means in the surrounding wall structure of the shaft structure, feeding endothermic material into the reaction chamber by means of said at least one cooling means in the surrounding wall structure of the shaft structure to form a first vertical reaction zone in the reaction chamber and to form a second vertical reaction zone in the reaction chamber below the first vertical reaction zone, dividing the second vertical reaction zone into at least two vertical sub-reaction zones by providing cooling means in the surrounding wall structure of the shaft structure at least two vertically different points of the surrounding wall structure of the shaft structure, and feeding endothermic material into the reaction chamber at least two vertically different points of the surrounding wall structure of the shaft structure to form a first vertical reaction zone in the reaction chamber and to form at least two vertical sub-reaction zones below the first reaction zone, wherein the sub-reaction zones containing more endothermic material than the first reaction zone.

16. A method for controlling the thermal balance of a suspension smelting comprising a reaction shaft, a lower furnace, and an uptake, wherein the reaction shaft having a shaft structure that is provided with a surrounding wall structure and a roof structure at the upper end of the surrounding wall structure and that limits a reaction chamber within the shaft structure, said reaction chamber having a lower end in communication with the lower furnace, and wherein the reaction shaft is provided with a concentrate burner for feeding pulverous solid matter and reaction gas into the reaction chamber, comprising:

providing the shaft structure of the reaction shaft with at least one cooling means for feeding endothermic material into the reaction chamber of the reaction shaft, feeding endothermic material into the reaction chamber of the reaction shaft with at least one cooling means, providing at least one cooling means at a level of at least 0.3 h measured from the lower end of the reaction chamber, where h is the height of the reaction chamber;

forming a first vertical reaction zone and a second vertical reaction zone in the reaction chamber by providing at least one cooling means in the surrounding wall structure of the shaft structure, feeding endothermic material into the reaction chamber by means of said at least one cooling means in the surrounding wall structure of the shaft structure to form a first vertical reaction zone in the reaction chamber and to form a second vertical reaction zone in the reaction chamber below the first vertical reaction zone, dividing the second vertical reaction zone into at least two vertical sub-reaction zones by providing cooling means in the surrounding wall structure of the shaft structure at least two vertically different points of the surrounding wall structure of the shaft structure, feeding endothermic material into the reaction chamber at least two vertically different points of the surrounding wall structure of the shaft structure to form a first vertical reaction zone in the reaction chamber and to form at least two vertical sub-reaction zones below the first reaction zone, forming a shoulder formation between two adjacent vertical sub-reaction zones, and providing at least one cooling means in the shoulder formation between two adjacent vertical sub-reaction zones.

17. A method for controlling the thermal balance of a suspension smelting comprising a reaction shaft, a lower furnace, and an uptake, wherein the reaction shaft having a shaft structure that is provided with a surrounding wall structure and a roof structure at the upper end of the surrounding wall structure and that limits a reaction chamber within the shaft structure, said reaction chamber having a lower end in communication with the lower furnace, and wherein the reaction shaft is provided with a concentrate burner for feeding pulverous solid matter and reaction gas into the reaction chamber, comprising:

providing the shaft structure of the reaction shaft with at least one cooling means for feeding endothermic material into the reaction chamber of the reaction shaft, feeding endothermic material into the reaction chamber of the reaction shaft with at least one cooling means, providing at least one cooling means at a level of at least 0.3 h measured from the lower end of the reaction chamber, where h is the height of the reaction chamber;

forming a first vertical reaction zone and a second vertical reaction zone in the reaction chamber by providing at least one cooling means in the surrounding wall structure of the shaft structure, feeding endothermic material into the reaction chamber by means of said at least one cooling means in the surrounding wall structure of the shaft structure to form a first vertical reaction zone in the reaction chamber and to form a second vertical reaction zone in the reaction chamber below the first vertical reaction zone, dividing the second vertical reaction zone into at least two vertical sub-reaction zones by providing cooling means in the surrounding wall structure of the shaft structure at least two vertically different points of the surrounding wall structure of the shaft structure, feeding endothermic material into the reaction chamber at least two vertically different points of the surrounding wall structure of the shaft structure to form a first vertical reaction zone in the reaction chamber and to form at least two vertical sub-reaction zones below the first reaction zone, providing at least one cooling means comprising a nozzle, and by arranging the nozzle to feed endothermic material into the reaction chamber of the reaction shaft at an angle of 30 to 60 degrees, with respect to the horizontal plane.

18. The method according to claim 1, comprising providing at least one cooling means at a distance 0.3 h to 0.7 h measured from the roof structure of the reaction chamber, where h is the height of the reaction chamber.

19. The method according to claim 1, comprising using at least one of the following as endothermic material: water, waste water such as municipal waste water, acid of different strengths, lime water, metallic salt and metallic sulphate.

20. The method according to claim 1, comprising feeding endothermic material additionally to pulverous solid matter that is fed into the reaction shaft by means of the concentrate burner and additionally to reaction gas that is fed into the reaction shaft by means of the concentrate burner.

21. The method according to claim 1, comprising using endothermic material in the form of fluid.

22. Suspension smelting furnace, comprising a reaction shaft, a lower furnace, and an uptake, wherein the reaction shaft having a shaft structure that is provided with a surrounding wall structure and a roof structure and that limits a reaction chamber, and wherein the reaction shaft is provided with a concentrate burner for feeding pulverous solid matter and reaction gas into the reaction chamber, wherein:

the shaft structure of the reaction shaft is provided with cooling means for feeding endothermic material into the reaction chamber of the reaction shaft, and at least one cooling means arranged at a level of at least 0.3 h measured from the lower end of the reaction chamber, where h is the height of the reaction chamber.

23. The suspension smelting furnace according to claim 22, comprising a cooling means in the shaft structure at a distance from and separately from the concentrate burner.

24. The suspension smelting furnace according to claim 22, comprising a cooling means in the roof structure of the shaft structure at a distance from and separately from the concentrate burner.

25. The suspension smelting furnace according to claim 22, comprising at least one cooling means comprising a nozzle, and wherein the nozzle is arranged to feed endothermic material into the reaction chamber of the reaction shaft at an angle of 65 to 85 degrees with respect to the horizontal plane.

26. The suspension smelting furnace according to claim 22, comprising a cooling means in the surrounding wall structure of the shaft structure.

27. The suspension smelting furnace according to claim 22, comprising at least one cooling means comprising a nozzle, and wherein the nozzle is arranged to feed endothermic material into the reaction chamber of the reaction shaft at an angle of 30 to 60 degrees, respect to the horizontal plane.

28. The suspension smelting furnace according to claim 22, comprising a shoulder formation in the surrounding wall structure of the shaft structure and at least one cooling means in the shoulder formation.

29. The suspension smelting furnace according to claim 22, wherein the reaction chamber comprises a first vertical reaction zone and a second vertical reaction zone below the first vertical reaction zone, and at least one cooling means is arranged in the surrounding wall structure of the shaft structure and is arranged to feed endothermic material into the reaction chamber so that the second vertical reaction zone contains endothermic material and so that the first vertical reaction zone is free of endothermic material.

30. The suspension smelting furnace according to claim 22, wherein the reaction chamber comprises a first vertical reaction zone and a second vertical reaction zone below the first vertical reaction zone, and at least one cooling means is arranged in the surrounding wall structure of the shaft structure and is arranged to feed endothermic material into the reaction chamber so that the second vertical reaction zone contains more endothermic material than the first vertical reaction zone.

31. The suspension smelting furnace according to claim 22, wherein the reaction chamber comprises a first vertical reaction zone and a second vertical reaction zone below the first vertical reaction zone, at least one cooling means is arranged in the surrounding wall structure of the shaft structure and is arranged to feed endothermic material into the reaction chamber, and the suspension smelting furnace comprises a shoulder formation between the first vertical reaction zone and the second vertical reaction zone, and a cooling means in the shoulder formation between the first vertical reaction zone and the second vertical reaction zone.

32. The suspension smelting furnace according to claim 22, wherein the reaction chamber comprises a first vertical reaction zone and a second vertical reaction zone below the first vertical reaction zone, at least one cooling means is arranged in the surrounding wall structure of the shaft structure and is arranged to feed endothermic material into the reaction chamber, at least one cooling means comprises a nozzle, and the nozzle is arranged to feed endothermic material into the reaction chamber of the reaction shaft at an angle of 30 to 60 degrees, preferable 40 to 50 degrees, with respect to the horizontal plane.

33. The suspension smelting furnace according to claim 22, wherein the reaction chamber comprises a first vertical reaction zone and a second vertical reaction zone below the first vertical reaction zone, at least one cooling means is arranged in the surrounding wall structure of the shaft structure and is arranged to feed endothermic material into the reaction chamber, and the suspension smelting furnace comprises the average cross section area of the first vertical reaction zone is smaller than the average cross section area of the second vertical reaction zone.

34. The suspension smelting furnace according to claim 22, wherein the reaction chamber comprises a first vertical reaction zone and a second vertical reaction zone below the first vertical reaction zone, at least one cooling means is arranged in the surrounding wall structure of the shaft structure and is arranged to feed endothermic material into the reaction chamber, and the suspension smelting furnace comprises the first vertical reaction zone is formed by the uppermost part of the reaction chamber.

35. The suspension smelting furnace according to claim 22, wherein the reaction chamber comprises a first vertical reaction zone and a second vertical reaction zone below the first vertical reaction zone, at least one cooling means is arranged in the surrounding wall structure of the shaft structure and is arranged to feed endothermic material into the reaction chamber, the second vertical reaction zone is divided into at least two vertical sub-reaction zones, and cooling means is arranged to feed endothermic material into the reaction chamber at least two vertically different points of the surrounding wall structure of the shaft structure to form a first vertical reaction zone free of endothermic material in the reaction chamber and to form at least two vertical sub-reaction zones below the first vertical reaction zone so that the at least two vertical sub-reaction zones contain endothermic material.

36. The suspension smelting furnace according to claim 22, wherein the reaction chamber comprises a first vertical reaction zone and a second vertical reaction zone below the first vertical reaction zone, at least one cooling means is arranged in the surrounding wall structure of the shaft structure and is arranged to feed endothermic material into the reaction chamber, the second vertical reaction zone is divided into at least two vertical sub-reaction zones, and cooling means is arranged to feed endothermic material into the reaction chamber at least two vertically different points of the surrounding wall structure of the shaft structure to form a first vertical reaction zone in the reaction chamber and to form at least two vertical sub-reaction zones below the first vertical reaction zone so that the at least two vertical sub-reaction zones contain more endothermic material than the first vertical reaction zone.

37. The suspension smelting furnace according to claim 22, wherein the reaction chamber comprises a first vertical reaction zone and a second vertical reaction zone below the first vertical reaction zone, at least one cooling means is arranged in the surrounding wall structure of the shaft structure and is arranged to feed endothermic material into the reaction chamber, the second vertical reaction zone being divided into at least two vertical sub-reaction zones, cooling means being arranged to feed endothermic material into the reaction chamber at least two vertically different, points of the surrounding wall structure of the shaft structure to form a first vertical reaction zone in the reaction chamber and to form at least two vertical sub-reaction zones below the first vertical reaction zone, and the suspension smelting furnace comprises a shoulder formation between two adjacent vertical sub-reaction zones, and at least one cooling means in the shoulder formation between two adjacent vertical sub-reaction zone.

38. The suspension smelting furnace according to claim 22, wherein the reaction chamber comprises a first vertical reaction zone and a second vertical reaction zone below the first vertical reaction zone, at least one cooling means is arranged in the surrounding wall structure of the shaft structure and is arranged to feed endothermic material into the reaction chamber, the second vertical reaction zone being divided into at least two vertical sub-reaction zones, cooling means being arranged to feed endothermic material into the reaction chamber at least two vertically different points of the surrounding wall structure of the shaft structure to form a first vertical reaction zone in the reaction chamber and to form at least two vertical sub-reaction zones below the first vertical reaction zone, at least one cooling means comprises a nozzle, and the nozzle is arranged to feed endothermic material into the reaction chamber of the reaction shaft at an angle of 30 to 60 degrees, with respect to the horizontal plane.

39. The suspension smelting furnace according to claim 22, comprising at least one cooling means arranged at a distance 0.3 h to 0.7 h measured from the roof structure of the reaction chamber, where h is the height of the reaction chamber.

40. The suspension smelting furnace according to claim 22, comprising at least one cooling means that is arranged to feed at least one of the following as endothermic material; water, waste water such as municipal waste water, acid of different strengths, lime water, metallic salt and metallic sulphate.

41. The suspension smelting furnace according to claim 22, comprising at least one cooling means that is arranged to feed endothermic material additionally to pulverous solid matter that is fed into the reaction shaft by means of the concentrate burner and additionally to reaction gas that is fed into the reaction shaft by means of the concentrate burner.

42. The suspension smelting furnace according to claim 22, comprising at least one cooling means that is arranged to feed endothermic material in the form of fluid, preferably in the form of liquid.

* * * * *